US006818850B2

(12) United States Patent
Bridges

(10) Patent No.: US 6,818,850 B2
(45) Date of Patent: Nov. 16, 2004

(54) DISCONNECT SWITCH FOR SWITCHING CAPACITIVE CURRENTS

(75) Inventor: Ronald P. Bridges, Heber Springs, AR (US)

(73) Assignee: Bridges Electric, Inc., Heber Springs, AR (US)

( * ) Notice: Subject to any disclaimer, the term of this patent is extended or adjusted under 35 U.S.C. 154(b) by 0 days.

(21) Appl. No.: 10/289,831

(22) Filed: Nov. 7, 2002

(65) Prior Publication Data

US 2004/0089635 A1 May 13, 2004

(51) Int. Cl.[7] ..... H01H 33/34
(52) U.S. Cl. ..... 218/154; 218/84
(58) Field of Search ..... 218/154, 153, 218/12, 14, 45, 78, 80, 84, 120, 140, 2, 7, 9–10, 118, 136

(56) References Cited

U.S. PATENT DOCUMENTS 4,983,792 A * 1/1991 Rogers et al. ..... 218/84
5,091,616 A * 2/1992 Ramos et al. ..... 218/9
5,483,030 A * 1/1996 Bridges ..... 218/12
5,534,673 A * 7/1996 Lehmann et al. ..... 218/68
5,808,258 A * 9/1998 Luzzi ..... 218/136

* cited by examiner

*Primary Examiner*—Lincoln Donovan
*Assistant Examiner*—M. Fishman
(74) *Attorney, Agent, or Firm*—Wood Phillips Katz Clark & Mortimer

(57) ABSTRACT

A disconnect apparatus for electrical power lines comprises a circuit interrupter having a fixed contact and a moveable contact. A linkage mechanism has first and second coupling elements. The second coupling element is secured to the moveable contact for operating the circuit interrupter. A drive mechanism has an output coupling element. An insulator assemble operatively connects the output coupling element to the linkage mechanism first coupling element. The insulator assembly comprises an insulator having a through bore. An insulator rod extends through the bore and is connected between the output coupling element and the linkage mechanism first coupling element. A dielectric seal is located between the insulator and the insulating rod.

16 Claims, 7 Drawing Sheets

DISCONNECT SWITCH FOR SWITCHING CAPACITIVE CURRENTS

FIELD OF THE INVENTION

This invention relates to an electrical power distribution circuit for electrical power distribution lines and, more particularly, to a disconnect apparatus for switching capacitive currents.

BACKGROUND OF THE INVENTION

Electrical power distribution systems often include overhead electrical power distribution lines mounted upon poles by a wide variety of mounting structures. Electrical power distribution systems require switching for many reasons, including fault isolation, transfer loads from one source to another, isolation of line segments for purpose of maintenance or new construction, and in some instances for shedding loads. Different loads vary the power factor of the electrical power distribution system. A decrease in the power factor may result in line losses. For example, with a reduction in power factor a distribution company may need to buy substantially greater power capacity than can be supplied, owing to the line losses.

To control the power factor electric power distribution systems may include capacitor banks associated with a utility line. A disconnect switch connects the capacitor banks to the power lines. However, conventional disconnect switches cannot switch capacitive currents. Instead, the conventional disconnect switches are intended to handle primarily resistive loads. Such switches will not interrupt capacitive currents.

The present invention is directed to solving one or more of the problems discussed above in a novel and simple manner.

SUMMARY OF THE INVENTION

In accordance with the invention, there is disclosed a disconnect apparatus for switching capacitive currents for electrical power lines.

Broadly, according to one aspect of the invention there is disclosed a disconnect apparatus for electrical power lines comprising a circuit interrupter having a fixed contact and a moveable contact. A linkage mechanism has first and second coupling elements. The second coupling element is secured to the moveable contact for operating the circuit interrupter. A drive mechanism has an output coupling element. An insulator assembly operatively connects the output coupling element to the linkage mechanism first coupling element. The insulator assembly comprises an insulator having a through bore. An insulator rod extends through the bore and is connected between the output coupling element and the linkage mechanism first coupling element. A dielectric seal is located between the insulator and the insulating rod.

It is a feature of the invention that the insulating rod comprises a fiberglass rod.

It is another feature of the invention that the dielectric seal comprises a silicon seal having a dielectric constant in a range of 400 to 600 volts/mil.

It is still another feature of the invention that the dielectric seal comprises a dual layer seal, one of the layers being a relatively firm dielectric gel and the other layer having a relatively high dielectric constant.

There is disclosed in accordance with another aspect of the invention a disconnect apparatus for switching capacitive currents for electrical power lines comprising a circuit interrupter having a fixed contact and a moveable contact. A first terminal connector is electrically connected to the fixed contact for connection to an electrical power line. A second terminal connector is electrically connected to the moveable contact for connection to a capacitive element. An adjustable linkage mechanism has first and second coupling elements and means for adjusting spacing between the first and second coupling elements. The second coupling element is secured to the moveable contact for operating the circuit interrupter. A drive mechanism is operatively connected to the linkage mechanism first coupling element for driving the circuit interrupter.

It is a feature of the invention that the second coupling element comprises a rod secured between the moveable contact and a rod cap of the linkage mechanism, and it is also a feature of the invention that the linkage mechanism included means for adjusting spacing between the first and second coupling elements comprises. The rod secured between the moveable contact and the rod cap is threaded for adjusting spacing between the moveable contact and the rod cap.

It is another feature of the invention that the linkage mechanism comprises a spring providing a clamping force on the second coupling element.

It is yet another feature of the invention that the linkage mechanism comprises a toggle arm hingedly mounted relative to the circuit interrupter and having a first end operatively connected to the first coupling element and a second end connected to a fitting receiving the second coupling element. The fitting comprises a spring providing a clamping force on the second coupling element.

Further features and advantages of the invention will be readily apparent from the specification and from the drawings.

DETAILED DESCRIPTION OF THE INVENTION

Figure 1:
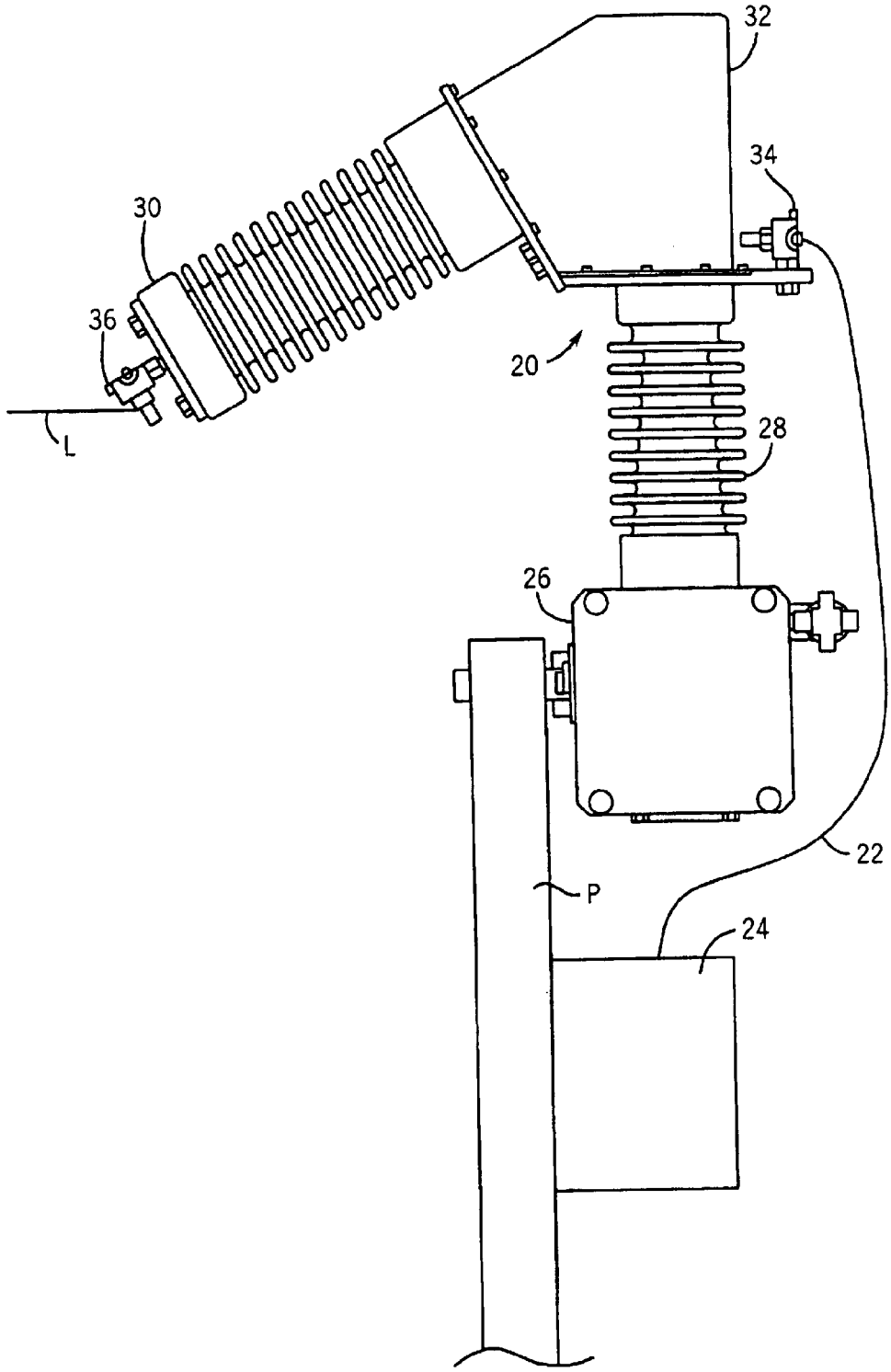
FIG. 1 is a front elevation view of a disconnect apparatus for electrical power lines in accordance with the invention mounted on a pole.

Referring to FIG. 1, an overhead electrical power distribution line L is carried on a pole P by a disconnect apparatus 20 in accordance with the invention. The disconnect apparatus 20 selectively connects the power distribution line L to a line 22 connected to a capacitor bank 24. The capacitor bank 24 is conventional in nature and is used to control power factor on the line L. Particularly, the disconnect apparatus 20 is selectively operable to switch on and off to maintain power factor on the line L at a high level. The disconnect apparatus 20 is adapted for interrupting capacitive currents from the overhead electrical power distribution line L to the line 22.

In the illustrated embodiment of the invention, the disconnect apparatus 20 is used for single phase power. As is apparent, the disconnect apparatus 20 could have three switches in a bank for switching three phase power.

Figure 2:
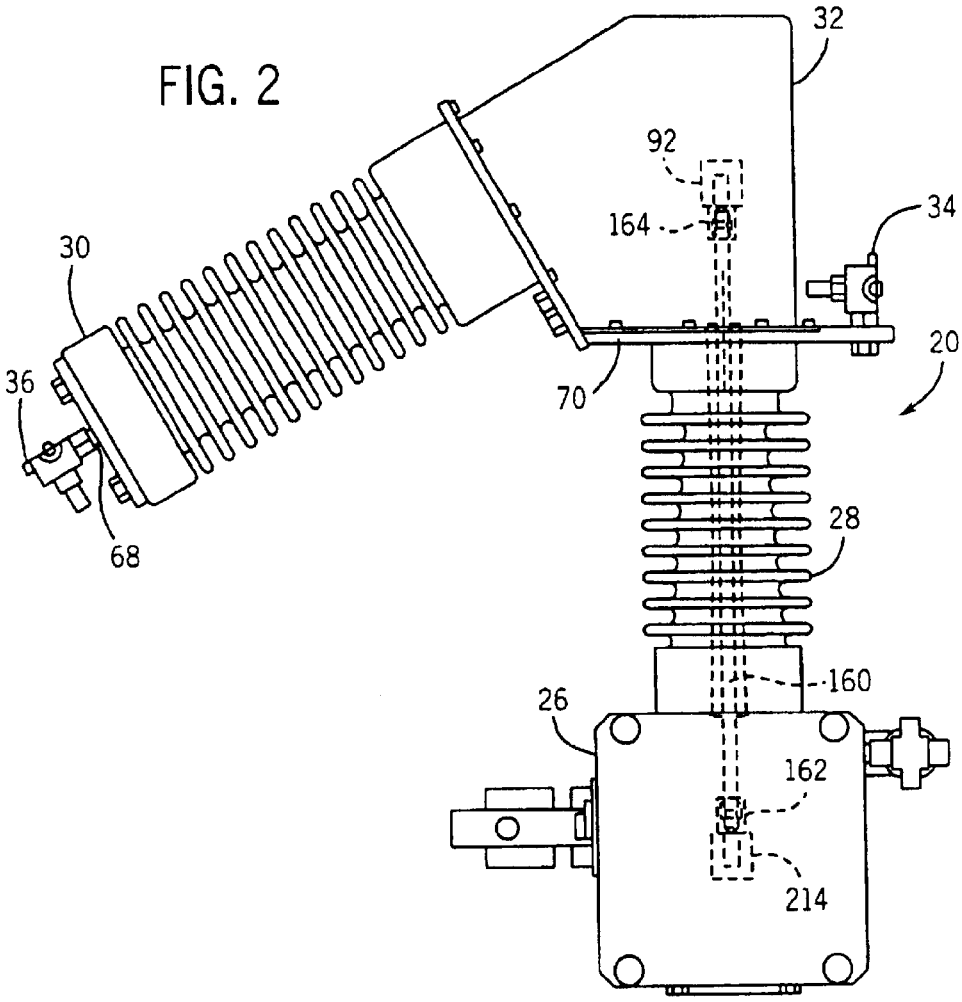
FIG. 2 is an enlarged side elevation view of the disconnect apparatus of FIG. 1 with an insulating rod and coupling elements illustrated in phantom.

Referring also to FIG. 2, the disconnect apparatus 20 is illustrated in greater detail. The disconnect apparatus 20 includes a base assembly 26, an insulator assembly 28, a vacuum interrupter assembly 30 and a housing 32. Terminal connectors 34 and 36 are electrically connected to the vacuum interrupter assembly 30. The first terminal connector 34 connects to the line 22, see FIG. 1. The second terminal connector 36 connects to the overhead electrical power distribution line L, see FIG. 1.

Figure 3:
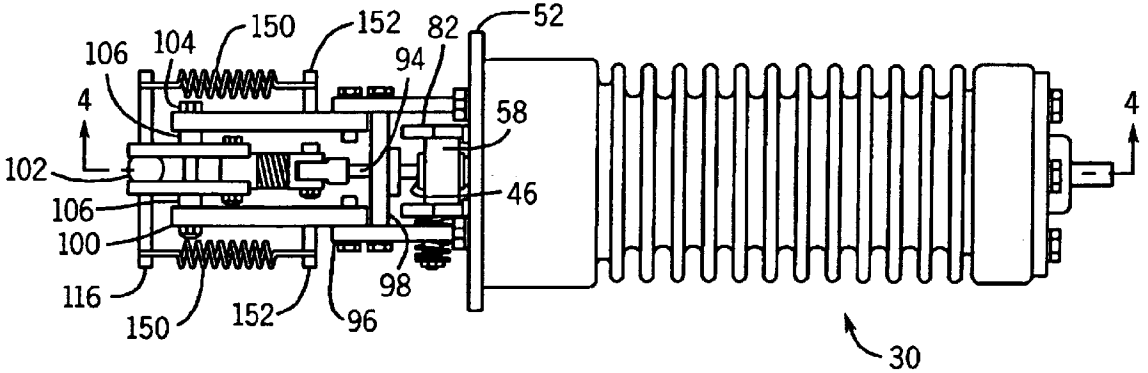
FIG. 3 is a top plan view of a vacuum interrupter assembly of the disconnect apparatus of FIG. 2.
Figure 4:
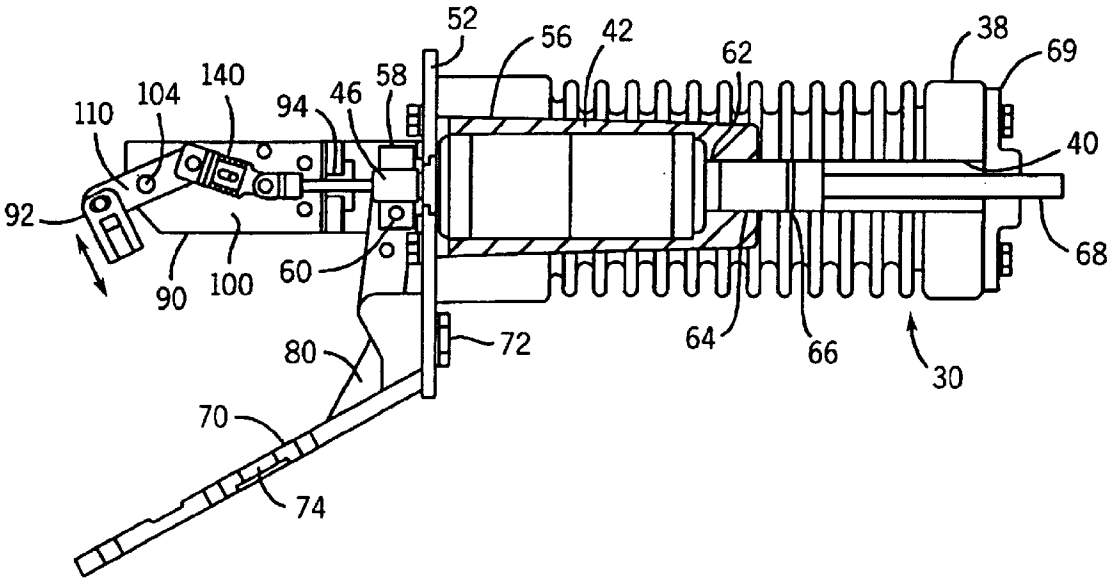
FIG. 4 is a sectional view taken along the line 4—4 of FIG. 3.
Figure 5:
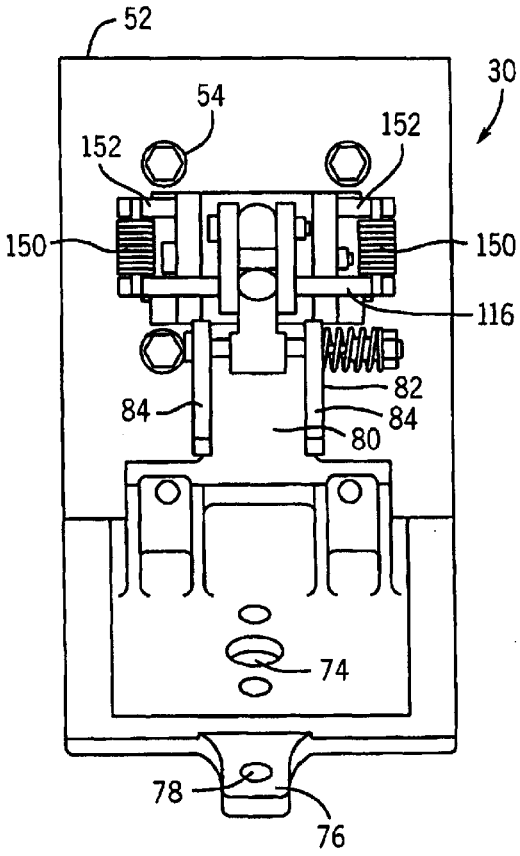
FIG. 5 is a side elevation view of the vacuum interrupter assembly of FIG. 3.

Referring to FIGS. 3–5, the vacuum interrupter assembly 30 is illustrated.

Figure 6:
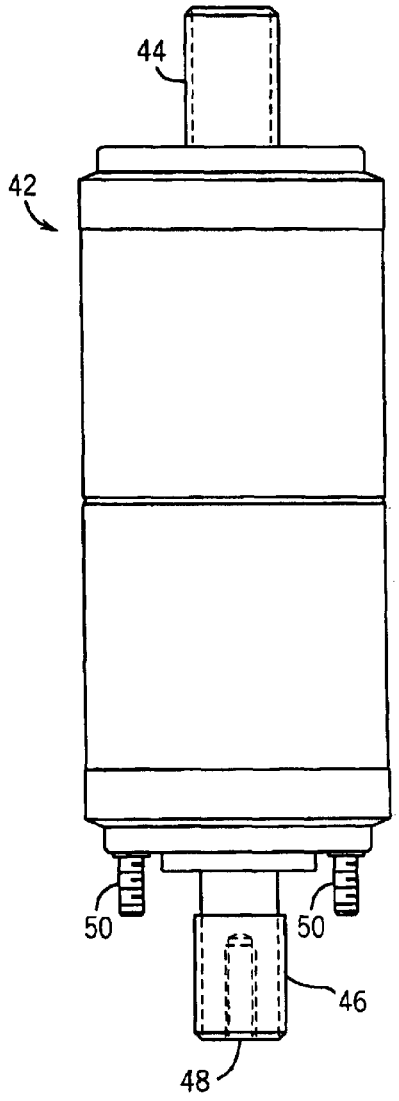
FIG. 6 is a plan view of a circuit interrupter of the disconnect apparatus of FIG. 3.

The vacuum interrupter assembly 30 includes a vacuum bottle bushing 38 including a through bore 40 housing a vacuum bottle 42. The vacuum bottle 42, see also FIG. 6, comprises a conventional circuit interrupter having a fixed contact represented by a fixed terminal 44 and a moveable contact represented by a moveable terminal 46. Particularly, the moveable terminal 46 is moved inwardly to close the circuit interrupter and outwardly to open the circuit interrupter, in a conventional manner. The moveable terminal 46 includes a threaded counterbore 48. Threaded studs 50 are provided for securing the vacuum bottle 42 to a mounting plate 52 using nuts (not shown) threaded to the studs 50. Likewise, the vacuum bottle bushing 38 is secured to the mounting plate 52 using bolts 54. A dielectric firm gel 56 surrounds the vacuum bottle 42 within the vacuum bottle bushing 38. Particularly, after the vacuum bottle 42 is assembled into the vacuum bottle bushing 38 the dielectric firm gel 56 is mixed and poured into the cavity. The mounting plate 52 is then assembled in order to locate the vacuum bottle 42 concentric with the bushing 38. This allows the gel to cure with components properly located.

A contact nut 58 is connected to the moveable terminal 46 and is secured with a cap screw 60. A lock nut 62 and conductor coupling 64 are threaded to the fixed terminal 44. An O-ring 66 surrounds the conductor coupling within the through bore 40. A conductor rod 68 is connected to the conductor coupling 64 and extends outwardly from a vacuum bushing end plate 69. The second terminal connector 36, see FIG. 2, is electrically connected to the conductor rod 68 in a conventional manner.

Figure 7:
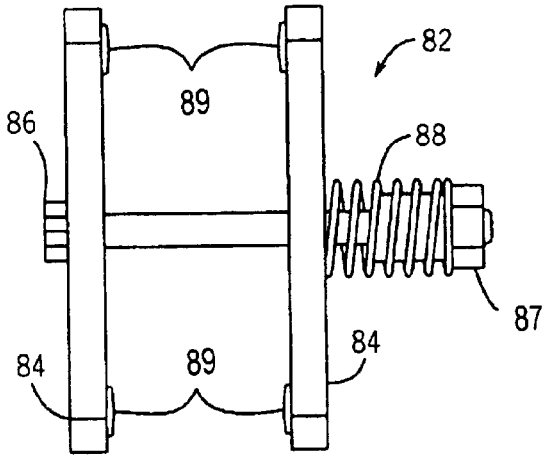
FIG. 7 is a side elevation view of a contact assembly of the vacuum interrupter assembly of FIG. 3.

A mount casting 70 is secured to the mounting plate 52 using bolts 72. The mount casting 70 is a machined conductive casting including a centrally located through bore 74. A distal end projection 76 has an opening 78 for receiving the first terminal connector 34, see FIG. 2. A post 80 extends upwardly from a near end. A contact assembly 82 connects the post 80 to the contact nut 58. The contact assembly 82 is shown in FIG. 7 and includes a pair of spaced apart parallel contact bars 84. A bolt 86 extends through central openings (not shown) in the contact bars 84. A spring 88 surrounds a distal end of the bolt 86 and is held thereon using a nut 87. Particularly, the spring 88 biases the contact bars 84 towards one another. Each contact bar 84 includes contact pads 89.

As shown in FIG. 3, the contact bars 84 sandwich the contact nut 58. The opposite ends of the contact bars 84 sandwich the post 80, see FIG. 5. As such, the contact assembly 82 maintains electrical connection between the contact nut 58, and thus moveable terminal 46, and the mount casting 70, and thus the first terminal connector 34. The contact pads 89 allow the contact bars 84 to pivot relative to both the post 80 and the contact nut 58, when the moveable terminal 46 is moved, with the spring 88 maintaining electrical connection.

A linkage mechanism 90, see FIG. 4, operates the moveable terminal 46. The linkage mechanism 90 has a first coupling element 92 and a second coupling element 94. The second coupling element 94 comprises a threaded rod threadably received in the moveable terminal threaded counterbore 48. The first coupling element 92 is moveable in a direction as indicated by the arrow proximate thereto to selectively move the second coupling element 94 axially relative to the vacuum bottle 42 for operating the circuit interrupter.

The linkage mechanism 90 includes bottom support legs 96 secured to the mounting plate 52. An H bar 98 maintains spacing between the bottom support legs 96. Top support legs 100 are secured to the bottom support legs 96. A hot parts mechanism 102 includes a shoulder screw 104 hingedly connecting the hot parts mechanism 102 to the top support legs 100. Nylon spacers 106 maintain the hot parts mechanism 102 centered between the top support legs 100.

Figure 8:
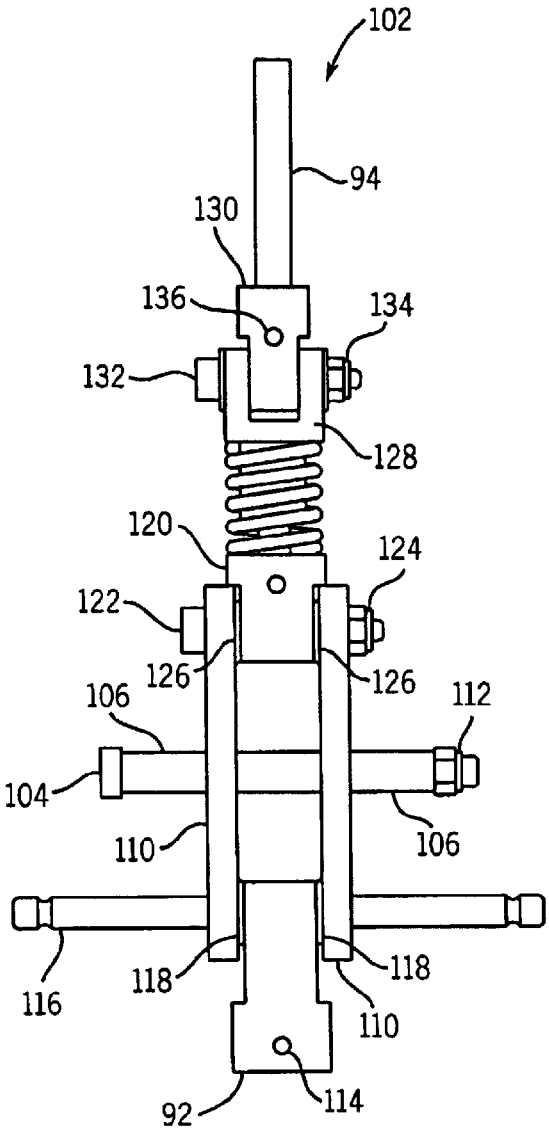
FIG. 8 is a top plan view of a linkage mechanism of the vacuum interrupter assembly of FIG. 3.
Figure 9:
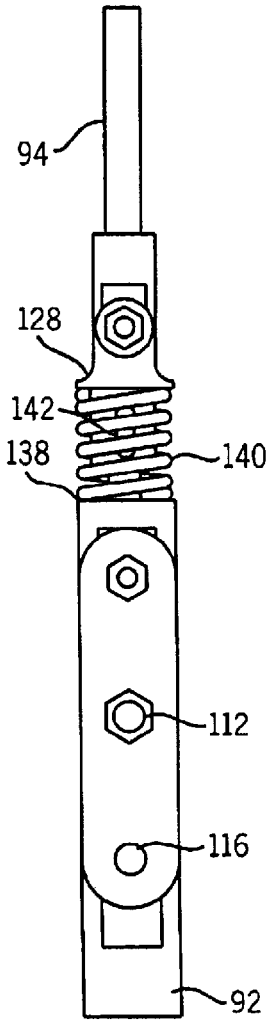
FIG. 9 is a side elevation view of the linkage mechanism of FIG. 8.

The hot parts mechanism 102 is illustrated in greater detail in FIGS. 8 and 9. A pair of toggle arms 110 centrally receive the shoulder screw 104. A jam nut 112 is provided on the distal end of the shoulder screw 104. The first coupling element 92 comprises an operating rod cap having a set screw 114. A latch spring rod 116 mounts the operating rod cap 92 to the toggle arms 110. Nylon washers 118 facilitate rotational movement of the rod cap 92 between the toggle arms 110. Upper ends of the toggle arm 110 receive a spring mechanism simple fitting 120 secured thereto with a shoulder screw 122 and lock nut 124. Nylon washers 126 facilitate rotation of the fitting 120 relative to the toggle arms 110. A spring fitting 128 hingedly supports a bottle rod cap 130 with a shoulder screw 132 and lock nut 134. The threaded rod 94 is received in the bottle rod cap 130 and is selectively secured in place using a set screw 136. Disposed between the spring fittings 120 and 128 are a Belleville washer 138 and a contact spring 140. The fittings are internally, loosely connected using a drive pin 142.

As particularly shown in FIG. 4, the toggle arms 110 are hingedly supported on the top support legs 100 with the shoulder screw 104. Upward movement of the first coupling element 92 moves the threaded rod 94 toward the vacuum bottle 42 to close the circuit interrupter. Conversely, downward movement of the first coupling element 92 pulls the threaded rod 94 away from the vacuum bottle 42 to interrupt the circuit. The contact spring 140 and Belleville washer 138 maintain a clamping force when the circuit interrupter is closed. This structure enables the disconnect apparatus 20 to switch capacitive currents. The threaded rod 94 can be turned, after loosening the set screw 135, to adjust spacing between the bottle rod cap 130 and the moveable terminal 46. This can be used to adjust the linkage to ensure the proper amount of force is placed on the contacts in the vacuum bottle 42.

Referring again to FIG. 3, tensions springs 150 extend between the spring rod 116 and spring pins 152 secured to near ends of the top support legs 100. This provides a bias on the second coupling element 94.

Figure 10:
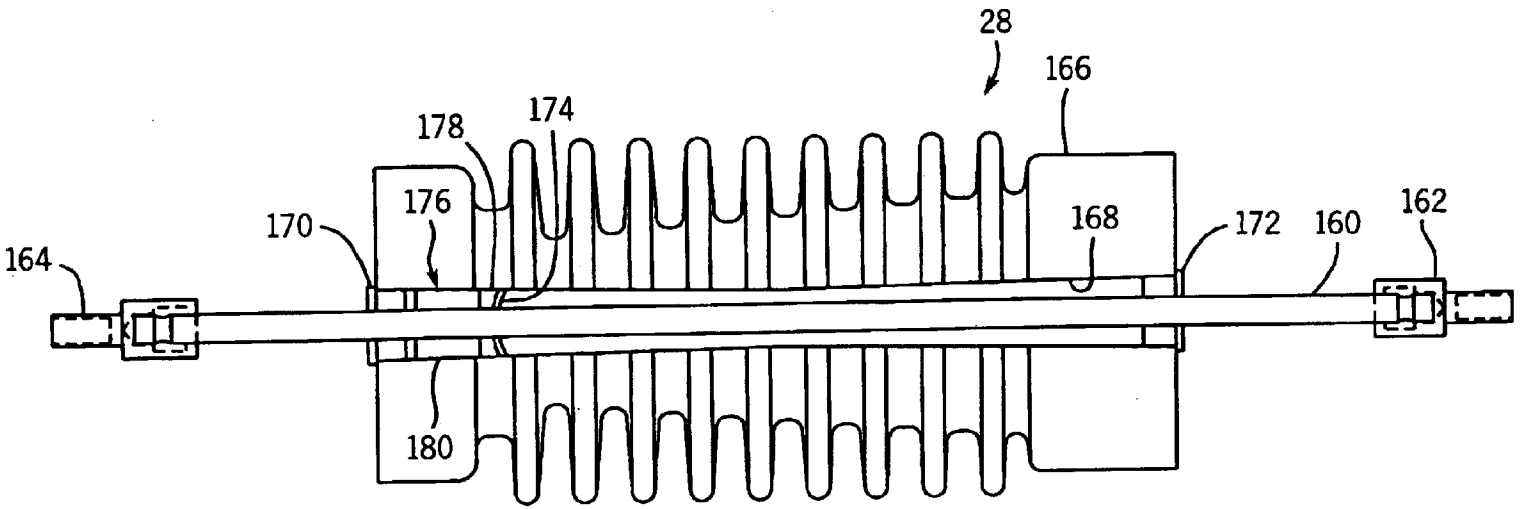
FIG. 10 is a partially cut away, side elevation view of an insulator subassembly of the disconnect apparatus of FIG. 2.

Referring to FIG. 10, the insulator assembly 28 is illustrated. The insulator assembly 28 comprises a fiberglass rod 160 having a first coupling element 162 at a lower and a second coupling element 164 at an upper end. An insulator 166 includes a through bore 168 receiving the fiberglass rod 160. An upper bushing 170 and lower nylon bushing 172 are received in opposite ends of the through bore 168 and center the fiberglass rod 160. A neoprene washer 174 extends between the rod 169 and the through bore 168. Sandwiched between the neoprene washer 174 and the upper nylon bushing 170 is a dual layer dielectric seal 176 comprising a dielectric firm gel 178 and a dielectric gel 180. The dual layer dielectric seal 176 increases the BIL insulating rating of the insulating assembly 28.

Particularly, to assemble the insulator assembly 28, the neoprene washer 174 is slid onto the fiber glass rod 160 which is then inserted into the insulator 166. The neoprene washer 174 is positioned approximately 2 to 2½ inches below the top end of the insulator 166. The dielectric firm gel 178 comprises a relatively fast setting silicone, such as a two part epoxy. The dielectric firm gel may by, for example, Dow Corning DC 3-4220-80. The dielectric firm gel 178 is mixed and allowed to sit a short time before pouring it into the insulator 168. After the gel 178 is poured into the cavity it should be allowed to cure before the dielectric gel 180 is added. The dielectric gel 180 comprises a dielectric material having a relative high dielectric constant on the order of, for example, 400 to 600 volts/mil. On such material is Dow Corning Seal Guard DC-527-2. As is apparent, other types of dielectric materials can be used for the dielectric firm gel 178 and the dielectric gel 180.

Figure 12:
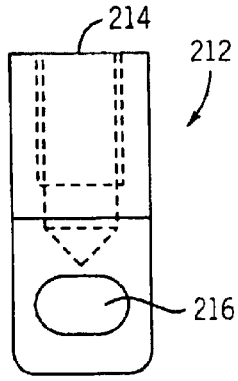
FIG. 12 is a side elevation view of a coupling element of the base mechanism of FIG. 11.
Figure 11:
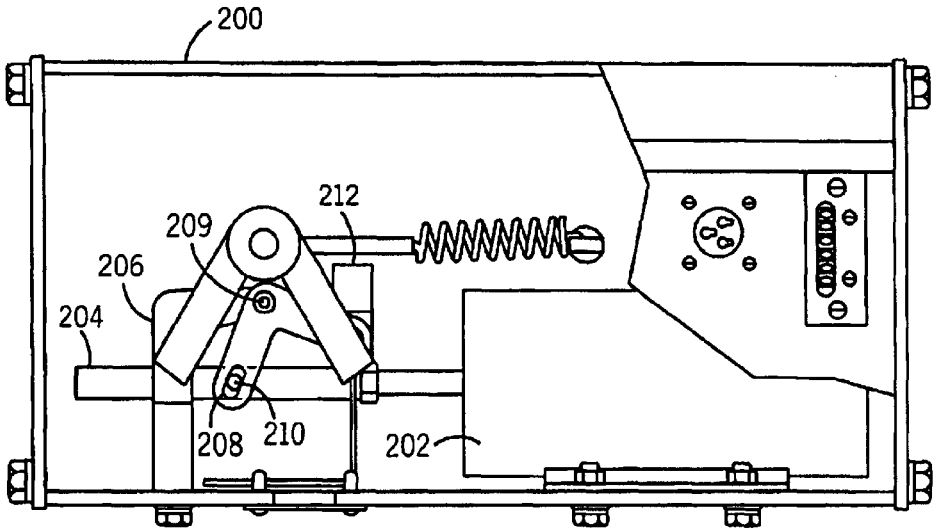
FIG. 11 is a side elevation view of a base assembly of the disconnect apparatus of FIG. 2.
Figure 13:
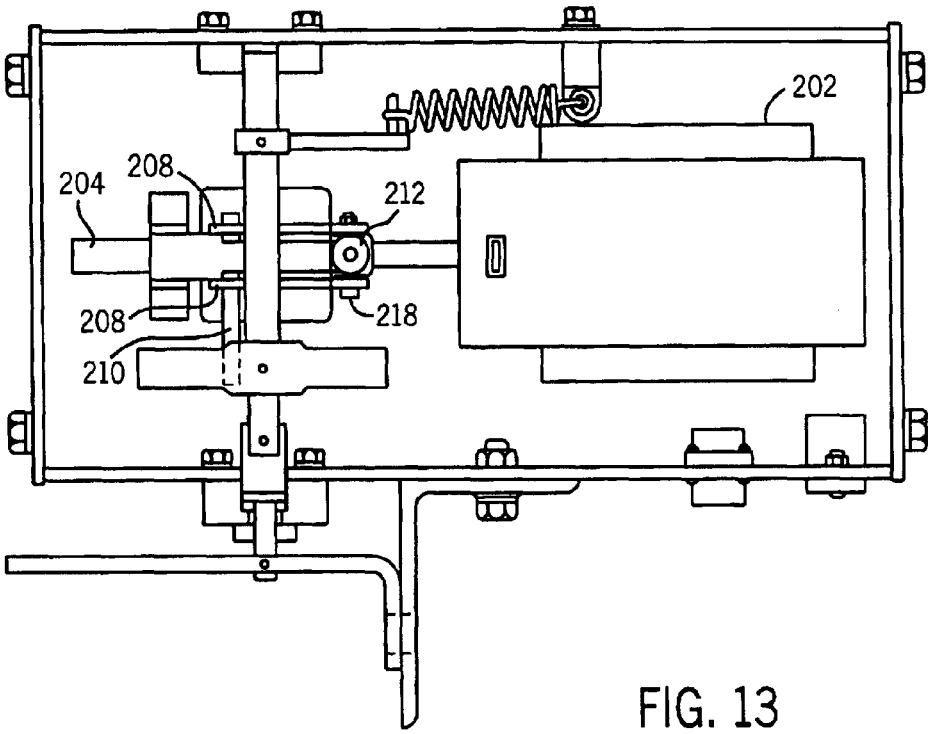
FIG. 13 is a top plan view of the base assembly of FIG. 11.

Referring to FIGS. 11–13, the base assembly 26 comprises a housing 200 enclosing a solenoid 202 having an output shaft 204. A bracket 206 is mounted in the housing and hingedly supports a pair of linear translation arms 208. The linear translation arms 208 are generally L-shaped. One end of the linear translation arms 208 is connected to the solenoid shaft 204 using a drive pin 210. An opposite end of the linear translation arms 208 is connected to a coupling end piece 212. The linear translation arms 208 pivot about a pin 209 on the bracket 206. As is apparent, horizontal movement of the solenoid shaft 204 is translated into vertical movement of the coupling end piece 212. The coupling end piece 212 is illustrated in FIG. 12 and is generally cylindrically shaped including an upper threaded counterbore 214. A through opening 216 is provided below the threaded counterbore 214. A shoulder screw 218, see FIG. 13, passes through the through opening 216 to secure the coupling end piece 212 to the linear translation arms 208.

Referring to FIG. 2, the insulator assembly 28 is mounted atop the base 26 with the first coupling element 162 threadably received in the base assembly coupling end piece 212. The fiberglass rod 160 extends upwardly. The upper end of the insulator assembly 28 is mounted to the mount casting 70 with the fiberglass rod 160 extending upwardly through the through opening 74, see FIG. 4. The upper end coupling element 164 is threaded into the operating rod cap 92.

Owing to the above-described relationship, horizontal movement of the solenoid shaft 204 is translated into vertical movement of the fiberglass rod 160. Vertical movement of the fiberglass rod 160 is translated into rotation of the hot parts mechanism 102 causing the threaded rod 94 to move toward and away from the vacuum bottle 42 to operate the circuit interrupter.

Thus, the invention broadly comprehends a disconnect apparatus for switching capacitive currents for electrical power lines.

I claim:

1. A disconnect apparatus for electrical power lines comprising:

a circuit interrupter having a fixed contact and a moveable contact;

a linkage mechanism having first and second coupling elements, the second coupling element being secured to the moveable contact for operating the circuit interrupter;

a drive mechanism having an output coupling element; and an insulator assembly operatively connecting the output coupling element to the linkage mechanism first coupling element, comprising an insulator having a through bore, an insulating rod extending through the bore and connected between the output coupling element and the linkage mechanism first coupling element, and a dielectric seal between the insulator and the insulating rod.

2. The disconnect apparatus for electrical power lines of claim 1 wherein the insulating rod comprises a fiberglass rod.

3. The disconnect apparatus for electrical power lines of claim 1 wherein the dielectric seal comprises a silicon seal having a dielectric constant in a range of 400 to 600 volts/mil.

4. The disconnect apparatus for electrical power lines of claim 1 wherein the dielectric seal comprises a dual layer seal, one of the layers being a relatively firm dielectric gel and the other layer having a relatively high dielectric constant.

5. A disconnect apparatus for switching capacitive currents for electrical power lines comprising:

a circuit interrupter having a fixed contact and a moveable contact;

a first terminal connector electrically connected to the fixed contact for connection to an electrical power line;

a second terminal connector electrically connected to the moveable contact for connection to a capacitive element;

a linkage mechanism having first and second coupling elements, the second coupling element being secured to the moveable contact for operating the circuit interrupter;

a drive mechanism having an output coupling element; and an insulator assembly operatively connecting the output coupling element to the linkage mechanism first coupling element, comprising an insulator having a through bore, an insulating rod extending through the bore and connected between the output coupling element and the linkage mechanism first coupling element, and a dielectric gel providing a seal between the insulator and the insulating rod.

6. The disconnect apparatus of claim 5 wherein the insulating rod comprises a fiberglass rod.

7. The disconnect apparatus of claim 5 wherein the dielectric seal comprises a silicon seal having a dielectric constant in a range of 400 to 600 volts/mil.

8. The disconnect apparatus of claim 5 wherein the dielectric seal comprises a dual layer seal, one of the layers being a relatively firm dielectric gel and the other layer having a relatively high dielectric constant.

9. A disconnect apparatus for switching capacitive currents for electrical power lines comprising:

a circuit interrupter having a fixed contact and a moveable contact;

a first terminal connector electrically connected to the fixed contact for connection to an electrical power line;

a second terminal connector electrically connected to the moveable contact for connection to a capacitive element;

an adjustable linkage mechanism having first and second coupling elements and means for adjusting spacing between the first and second coupling elements, the second coupling element being secured to the moveable contact for operating the circuit interrupter; and a drive mechanism operatively connected to the linkage mechanism first coupling element for driving the circuit interrupter.

10. The disconnect apparatus of claim 9 wherein the second coupling element comprises a rod secured between the moveable contact and a rod cap of the linkage mechanism and the means for adjusting spacing between the first and second coupling elements comprises threads on the rod for adjusting space between the moveable contact and the rod cap.

11. The disconnect apparatus of claim 9 wherein the linkage mechanism comprises a spring and Belleville washer providing a clamping force on the second coupling element.

12. The disconnect apparatus of claim 9 wherein the linkage mechanism comprises a toggle arm hingedly mounted relative to the circuit interrupter and having a first end operatively connected to the first coupling element and a second end connected to a fitting receiving the second coupling element.

13. The disconnect apparatus of claim 12 wherein the fitting comprises a spring providing a clamping force on the second coupling element.

14. The disconnect apparatus of claim 13 wherein the second coupling element comprises a rod secured between the moveable contact and a rod cap of the fitting and the means for adjusting spacing between the first and second coupling elements comprises threads on the rod for adjusting space between the moveable contact and the rod cap.

15. The disconnect apparatus of claim 9 wherein the drive mechanism comprises an actuator having an output coupling element, and an insulator assembly operatively connecting the output coupling element to the linkage mechanism first coupling element, comprising an insulator having a through bore, an insulating rod extending through the bore and connected between the output coupling element and the linkage mechanism first coupling element, and a dielectric gel providing a seal between the insulator and the insulating rod.

16. The disconnect apparatus of claim 15 wherein the actuator comprises a solenoid.

* * * * *